US008091560B2

(12) United States Patent
Kim et al.

(10) Patent No.: US 8,091,560 B2
(45) Date of Patent: Jan. 10, 2012

(54) ELECTRIC MASCARA

(75) Inventors: HakChan Kim, Gunpo-si (KR); JuHo Kim, Anyang-si (KR)

(73) Assignee: Amorepacific Corporation (KR)

( * ) Notice: Subject to any disclaimer, the term of this patent is extended or adjusted under 35 U.S.C. 154(b) by 339 days.

(21) Appl. No.: 12/278,759

(22) PCT Filed: Dec. 8, 2006

(86) PCT No.: PCT/KR2006/005324

§ 371 (c)(1), (2), (4) Date: Aug. 7, 2008

(87) PCT Pub. No.: WO2007/094552

PCT Pub. Date: Aug. 23, 2007

(65) Prior Publication Data

US 2009/0025746 A1 Jan. 29, 2009

(30) Foreign Application Priority Data

Feb. 16, 2006 (KR) ..... 20-2006-0004384

(51) Int. Cl.
*A45D 2/48* (2006.01)
*A45D 40/26* (2006.01)

(52) U.S. Cl. ..... 132/217; 132/218

(58) Field of Classification Search ..... 132/218, 132/317, 320; 15/23, 24
See application file for complete search history.

(56) References Cited

U.S. PATENT DOCUMENTS 4,056,111 A * 11/1977 Mantelet ..... 132/218
2002/0014251 A1* 2/2002 Gueret ..... 132/218
2005/0160542 A1* 7/2005 Jung ..... 15/23

* cited by examiner

*Primary Examiner* — Rachel Steitz
(74) *Attorney, Agent, or Firm* — John K. Park; Park Law Firm

(57) ABSTRACT

An electric mascara for makeup of eyelash by using a mascara brush is provided, An electric mascara includes a cap including a rotary switch which is operated by a handle, a motor which is operated according to the ON/OFF operation of the rotary switch and a decelerator to which motive power of the motor is supplied; a brush stick which is connected to a revolving axis of the decelerator; and a mascara brush installed at the end of the brush stick. The mascara brush is formed by piling disk-type comb tooth in serial with a space enough to form a trough, where mascara solution can be charged, and in zigzag so that eccentricity is generated; and an eyelash curling portion and a mascara solution applying portion with shorter length then the eyelash curling portion are formed at the mascara brush.

5 Claims, 14 Drawing Sheets

[Fig. 1]
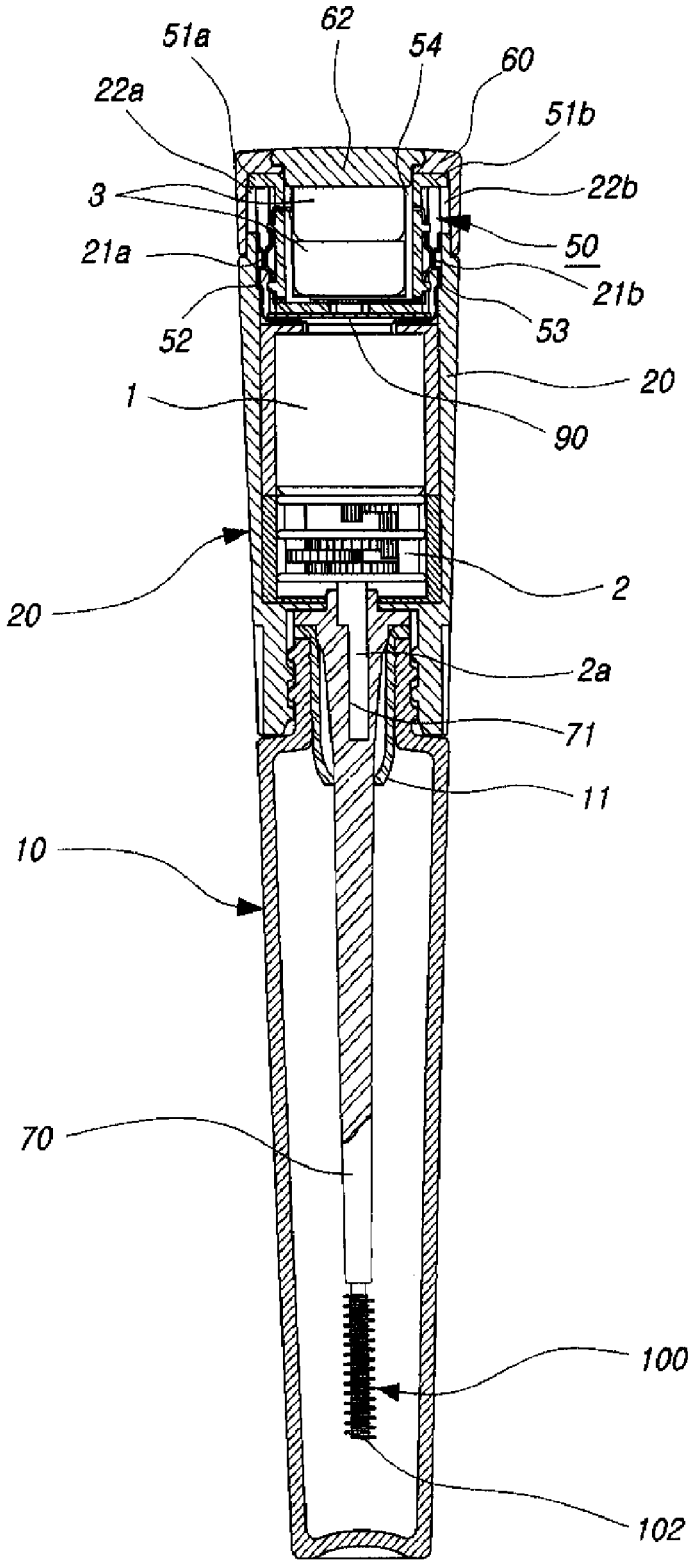

[Fig. 2]
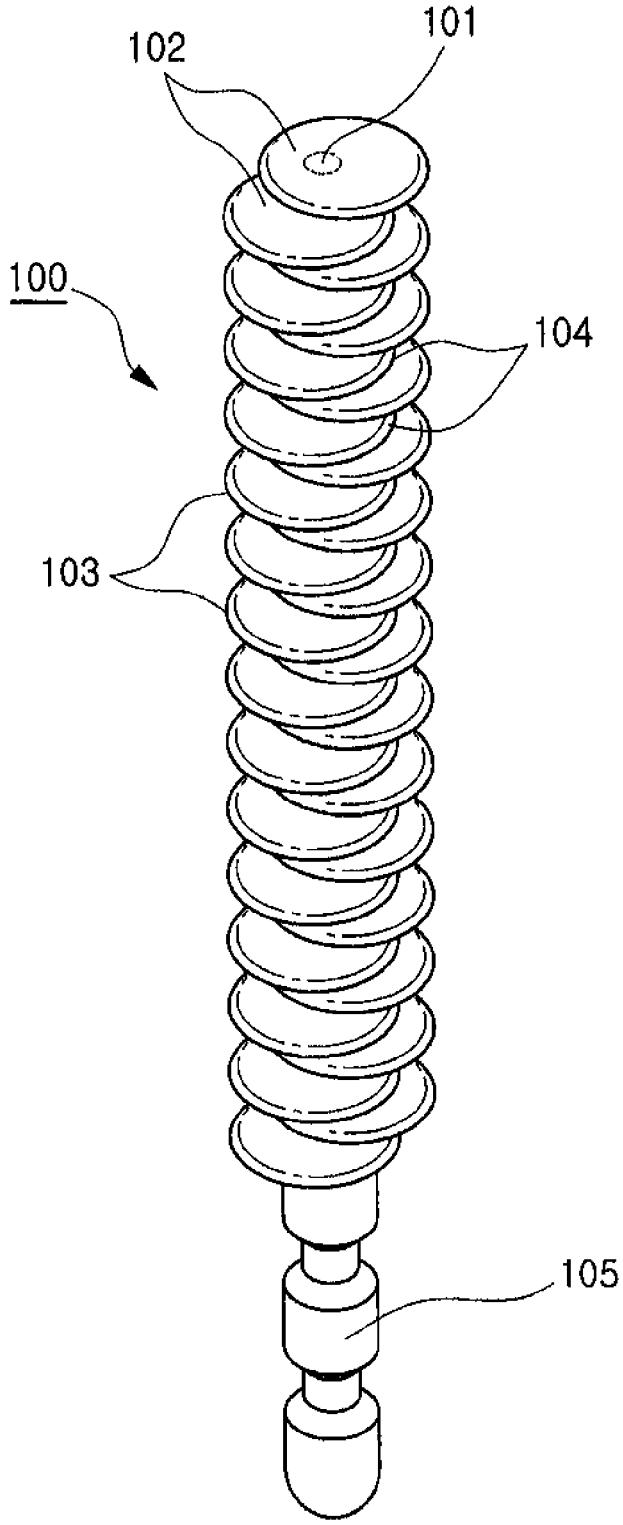

[Fig. 3]
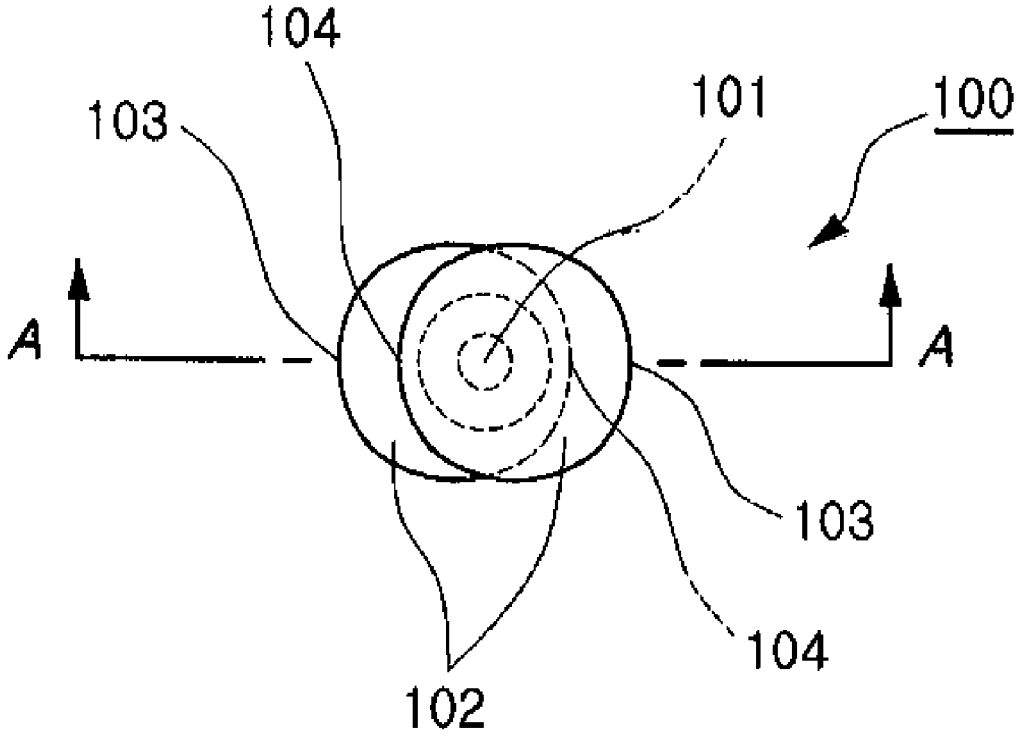

[Fig. 4]
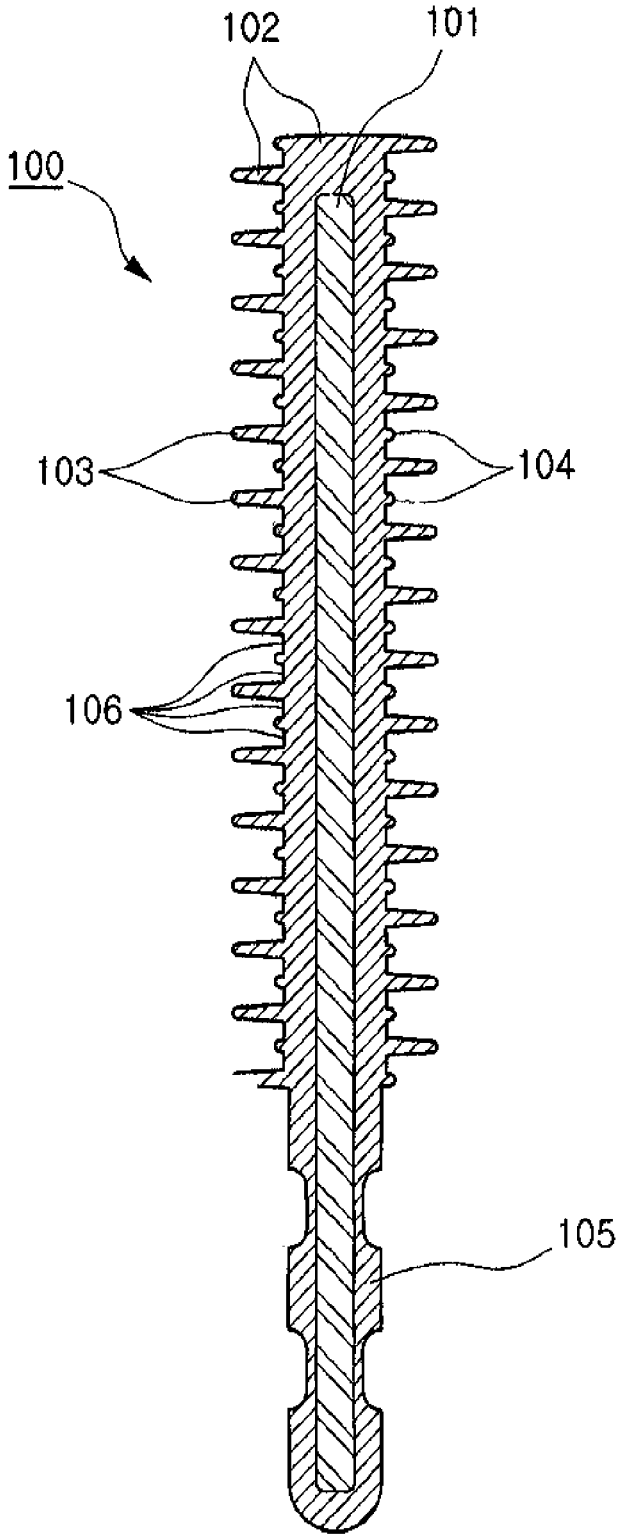

[Fig. 5]
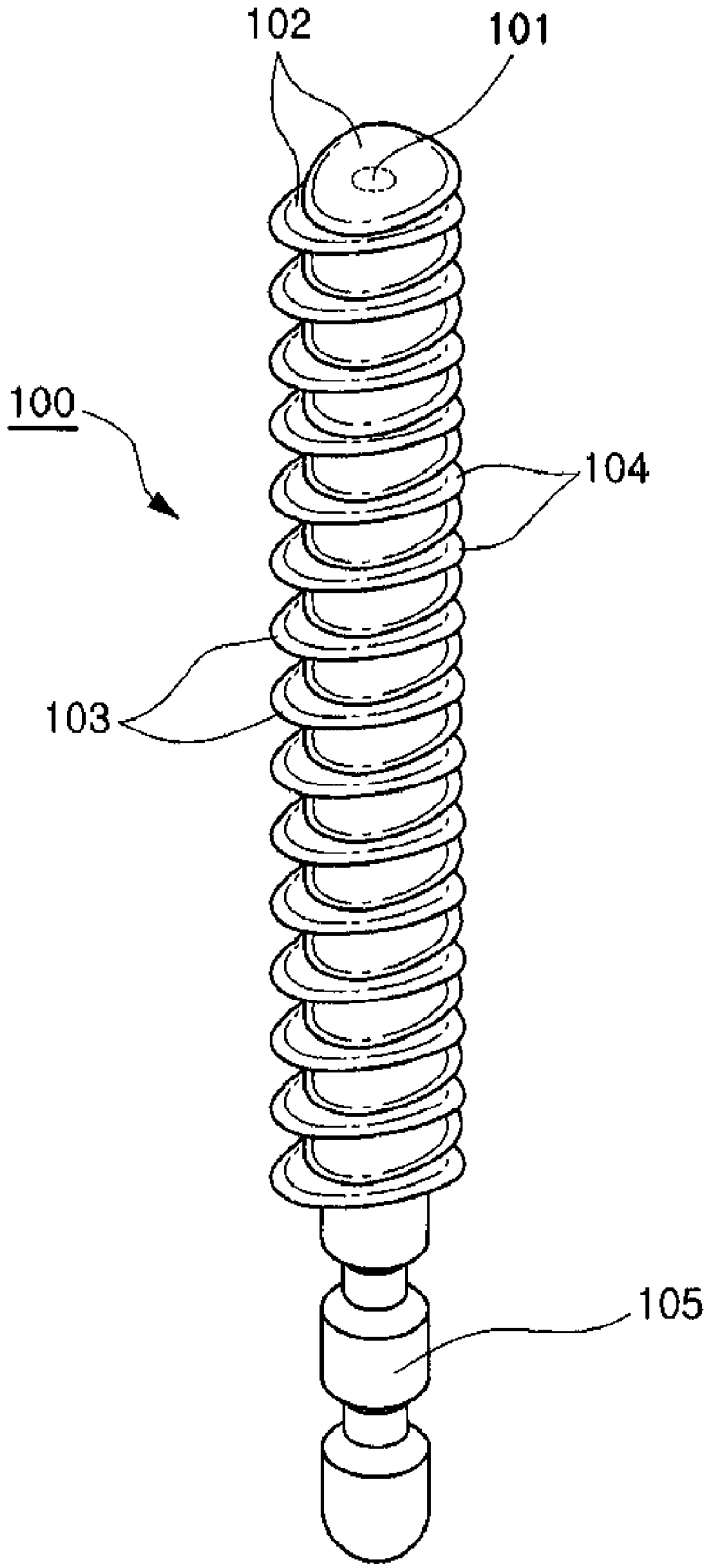

[Fig. 6]
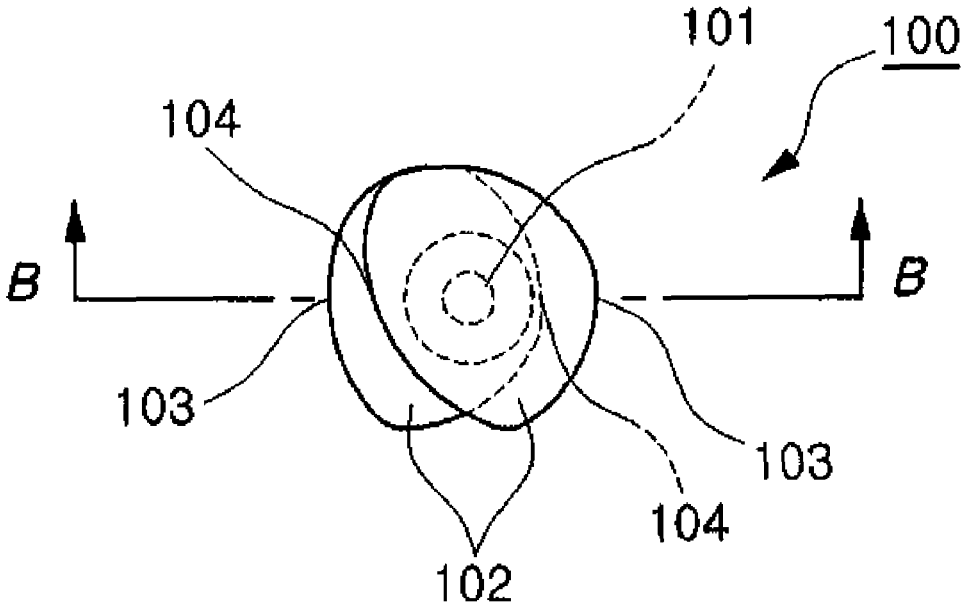

[Fig. 7]
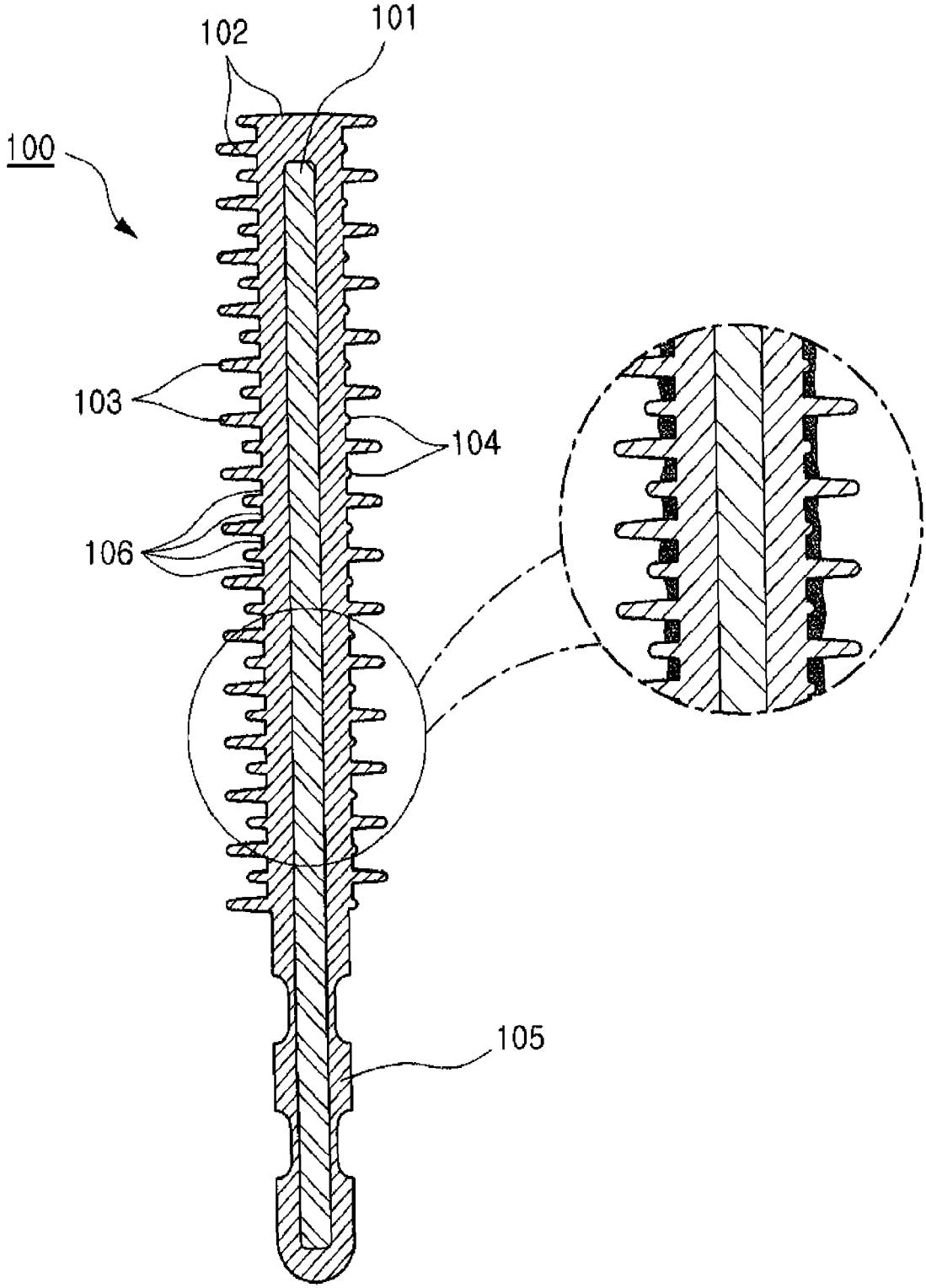

[Fig. 8]
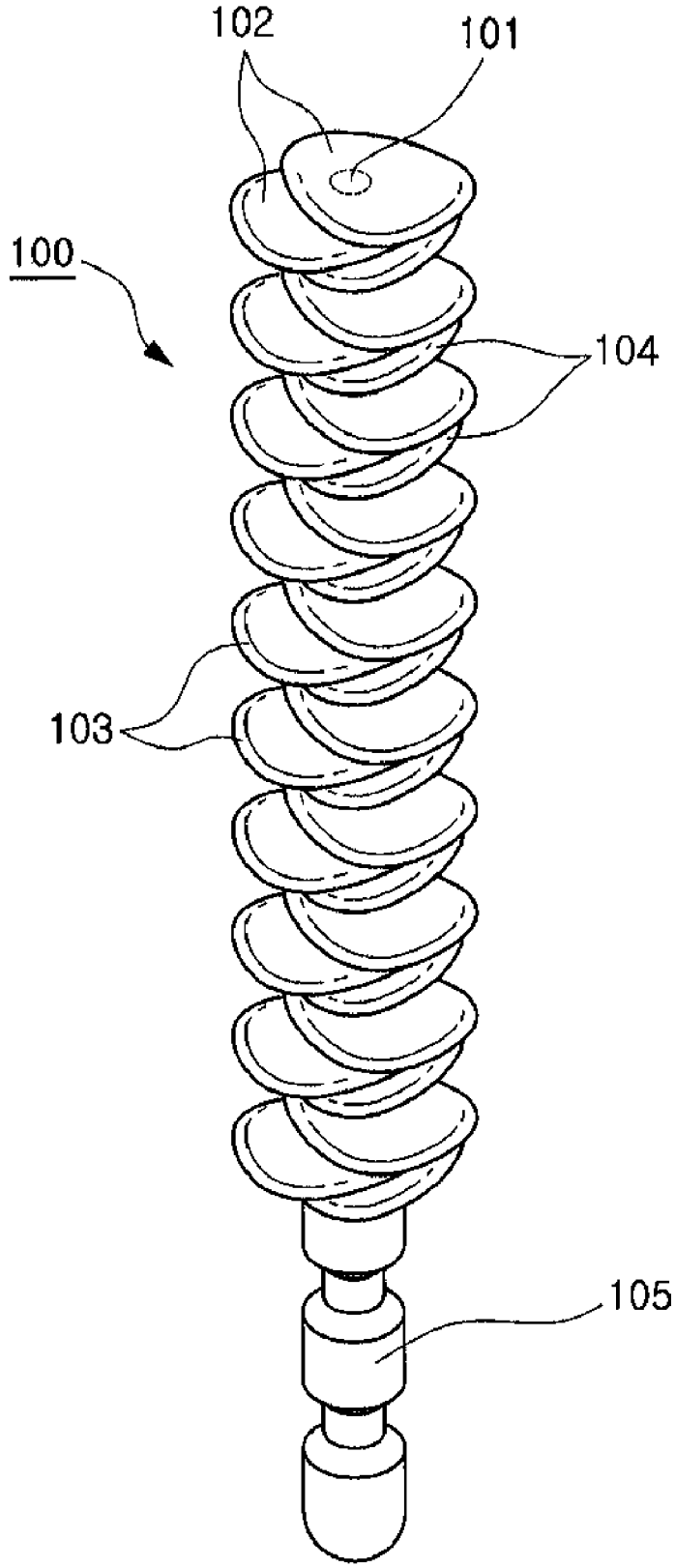

[Fig. 9]
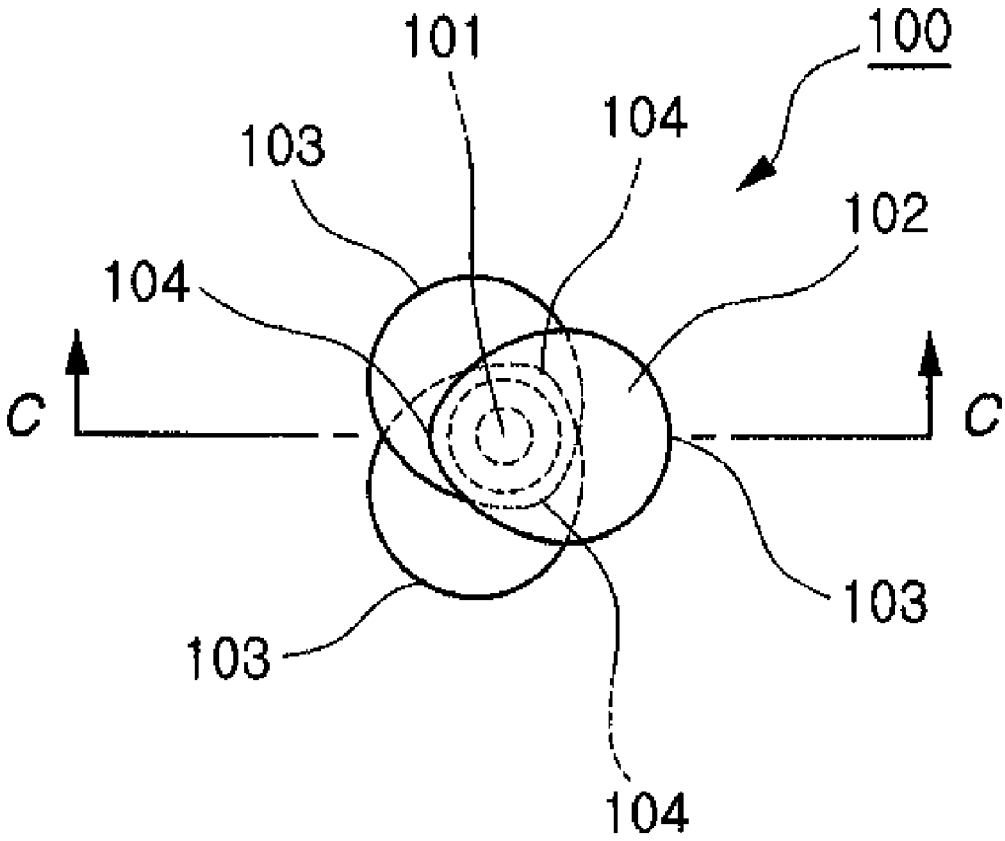

[Fig. 10]
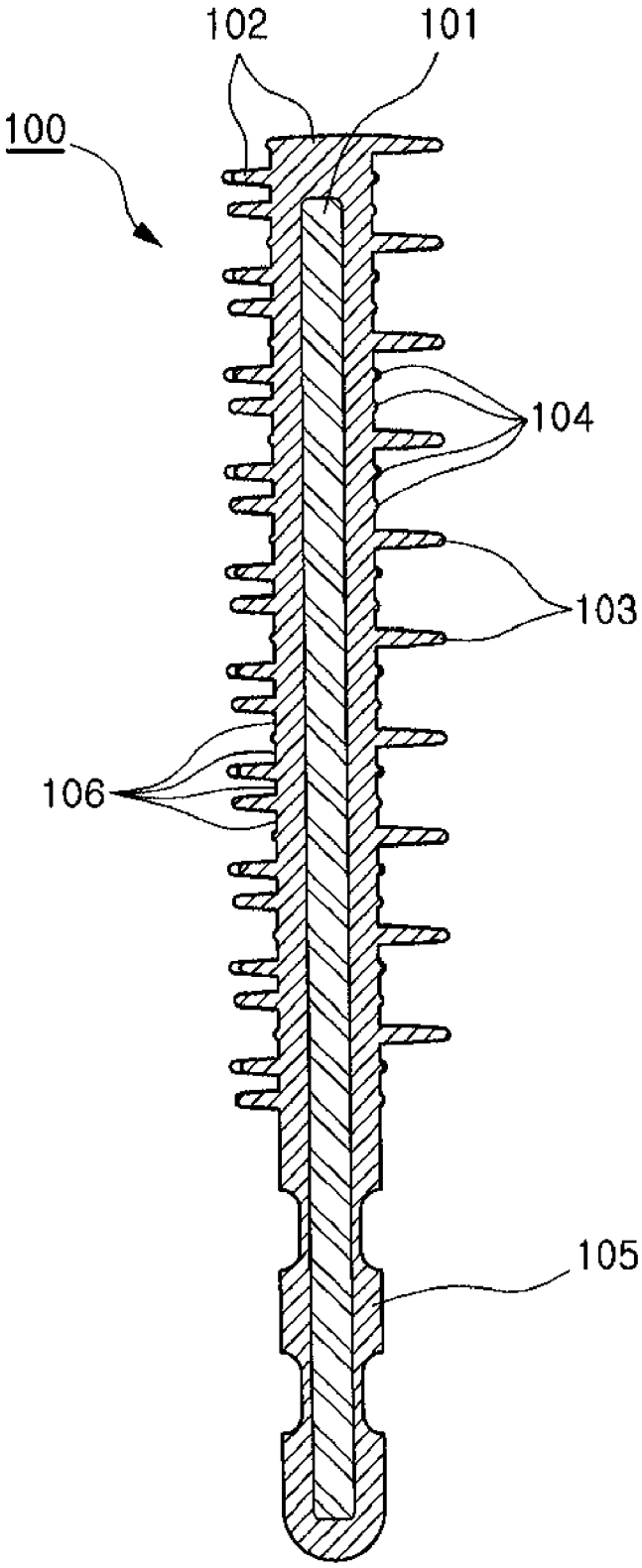

[Fig. 11]
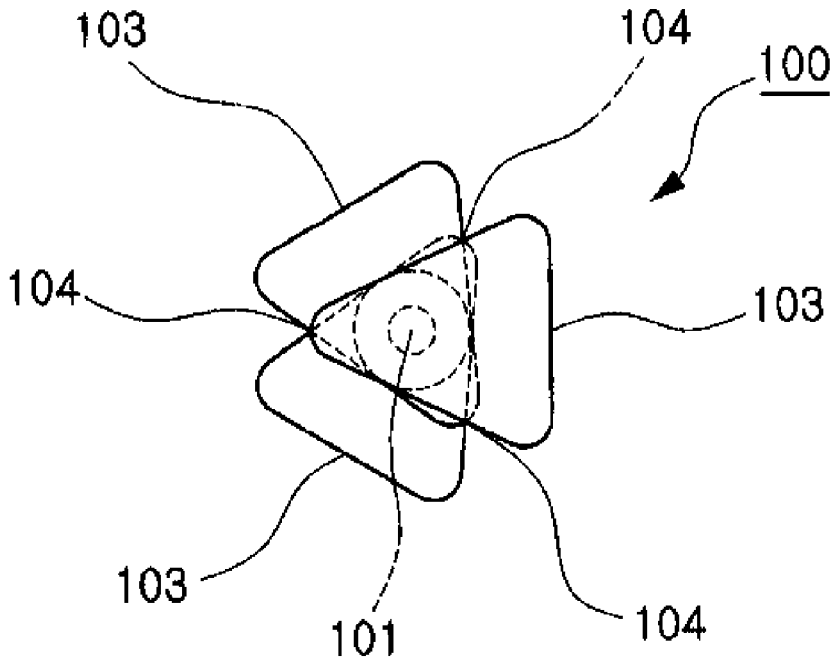
[Fig. 12]
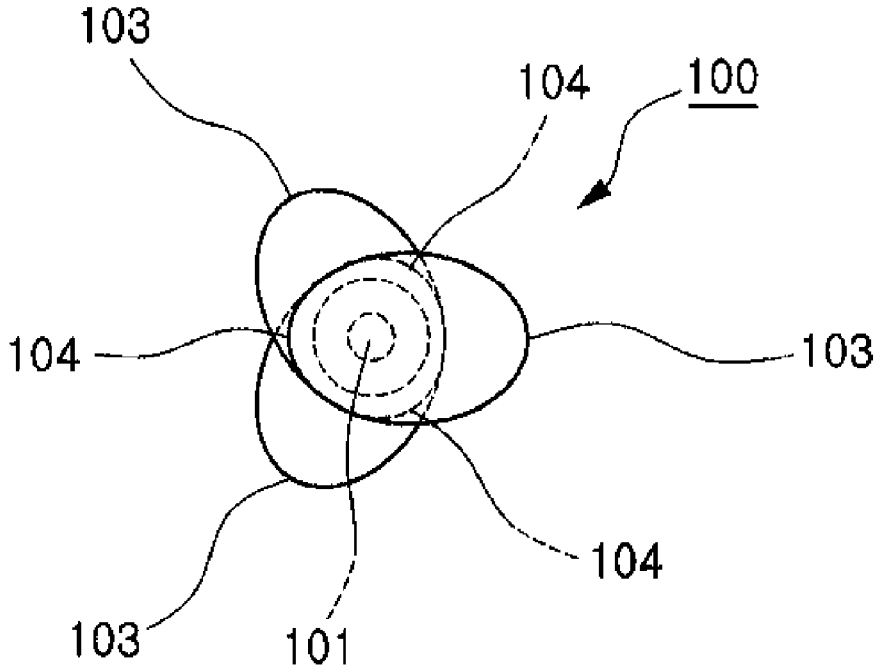

[Fig. 13]
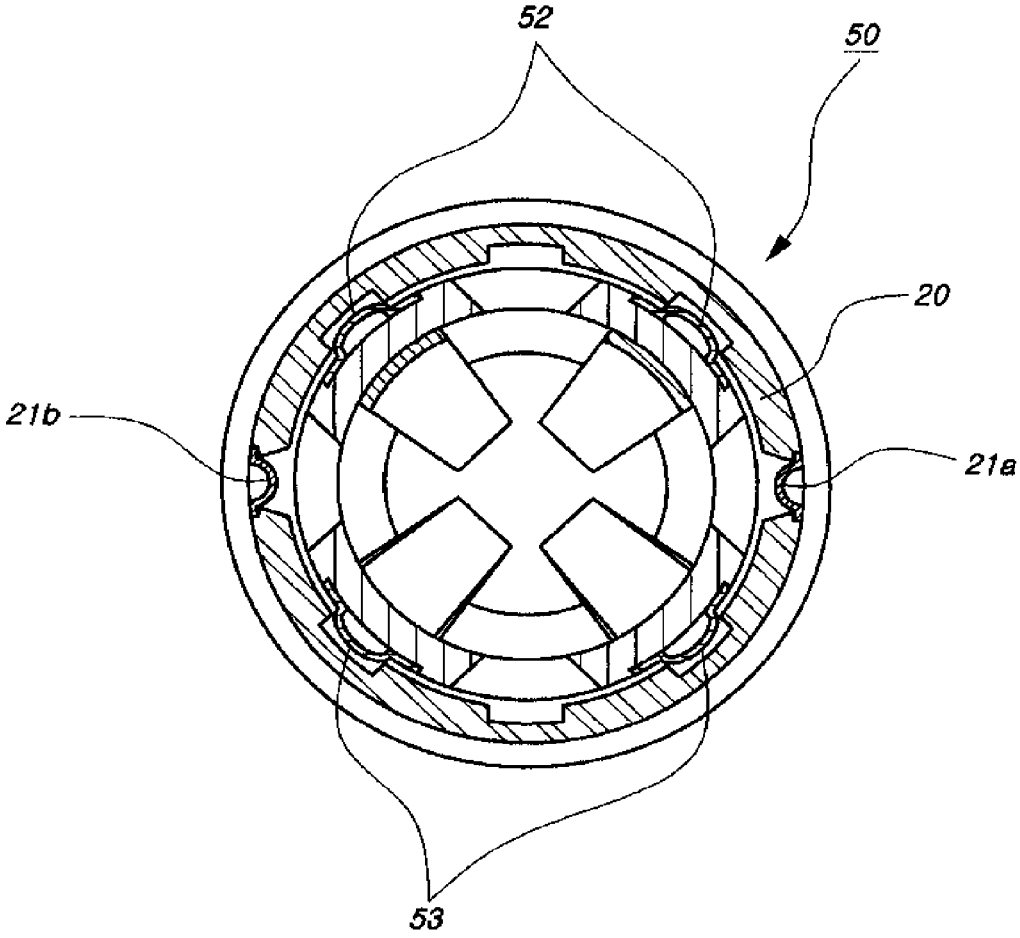

[Fig. 14]
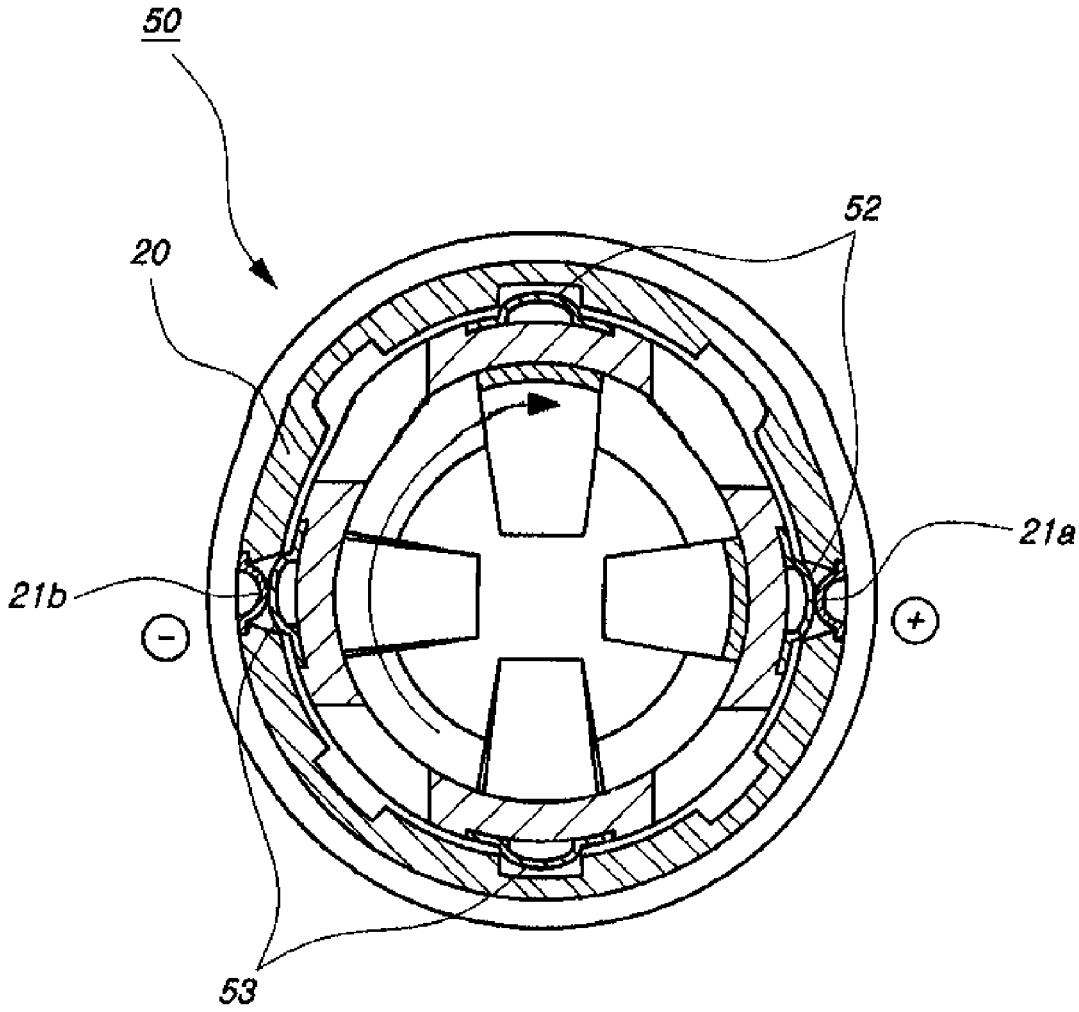

[Fig. 15]
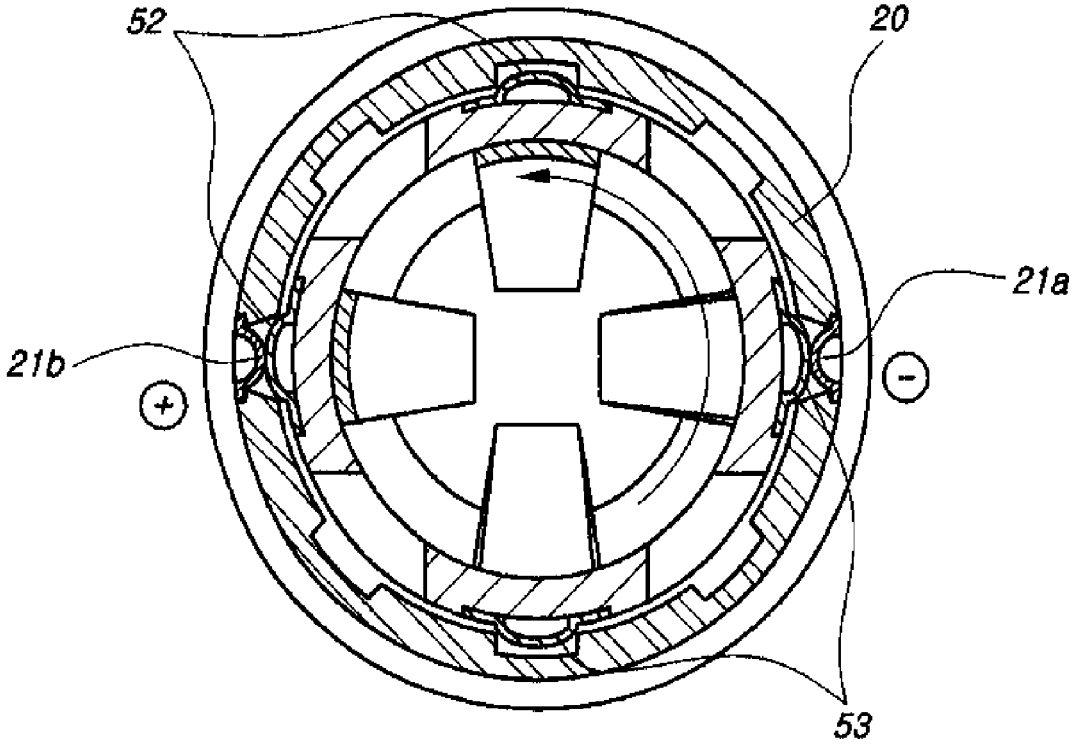

ELECTRIC MASCARA

TECHNICAL FIELD

The present invention relates to an electric mascara for makeup of eyelash by using a mascara brush, which is cooperated with a brush stick when the brush stick is revolved forwardly or reversely by the driving force of a motor, and more particularly, to an electric mascara having a mascara brush which is made not by a plastic string but by disk-type comb tooth of silicon, which is safe as it is softer than the plastic string, and which is formed by piling disk-type comb tooth in serial with a space enough to form a trough, where mascara solution can be charged, and in zigzag so that eccentricity is generated, thereby an eyelash curling portion and a mascara solution applying portion with shorter length then the eyelash curling portion are formed at the mascara brush, thereby makeup of eyelash can be done while pasting mascara solution to eyelash evenly and clearly.

BACKGROUND ART

Mascara, a kind of makeup instruments, is used to makeup eyelash to look longer and thicker than it is. Mascara makes eyelash waved so that it looks beautiful, for eyelash stretches itself out upward or downward.

There are two kinds of representative mascaras; one is a handy type mascara and the other is an electric mascara, The handy type mascara is revolved directly by a user while the electric mascara is revolved by a motor.

The handy type mascara has a problem to hurt eyes of user when makeup eyelash because plastic brush strings, which construct the brush, happen to pierce eyes. In addition, some user, who are not used to makeup eyelash, can be suffered to curl eyelash and to decorate eyelash beautifully. In some cases, lumping of mascara can be occurred because mascara solution cannot be pasted to eyelash evenly.

So, the electric mascara was developed to solve problems due to the handy type mascara.

The electric mascara transmits motive power of a motor to a brush stick, where a brush is installed, so that the brush can be revolved.

Because user does not revolve the mascara brush directly, some user, who is not used to makeup of eyelash, can perform makeup of eyelash easily. However, safeness in use is needed because the mascara brush is revolved automatically.

In the case that the mascara brush is constructed by a plastic string, user can be hurt due to the hardness of the plastic string. So, safeness is necessary.

If a mascara rubber brush with silicon is used, problems of safeness can be solved easily.

One of electric mascaras in consideration with safeness can be shown in registered Korean utility patent No. 404002.

The registered invention is advantageous in that anyone can perform makeup of eyelash easily by pasting mascara solution of the mascara brush to eyelash because a mascara brush, whose tooth are formed by thread and trough in serial on its outer circumference, is installed at the brush stick, which is revolved by a motor.

DISCLOSURE OF INVENTION

Technical Problem

However, mascara solution cannot be charged sufficiently at threads because the depth from the thread to the trough is not deep sufficiently. So there is an inconvenience to paste mascara solution in many times when makeup of eyelash. In addition, well-looking eyelash makeup is performed hardly because threads cannot dig into eyelash deeply enough to comb eyelash up. Further, curling of eyelash cannot be done well.

Technical Solution

An object of the present invention is to provide an electric mascara installing a mascara brush, where disk-type comb tooth are formed in serial with a space enough to form trough, where mascara solution can be maintained, disk-type comb tooth are formed to have eccentricity in one, two, or three directions from the center axis; and shape of disk-type comb tooth is various, so that it is safe when makeup of eyelash using an electric mascara.

Another object of the present invention is to provide an electric mascara installing a mascara brush in which disk-type comb tooth has an mascara solution applying portion to apply mascara solution to eyelash and an eyelash curling portion which digs among eyelash to paste applied mascara solution to eyelash evenly and curls eyelash, so that mascara solution can be applied to eyelash sufficiently and mascara solution can be pasted to eyelash evenly, thereby clear and sweet makeup of eyelash can be performed.

An electric mascara according to the present includes a cap including a rotary switch which is operated by a handle, a motor which is operated according to the ON/OFF operation of the rotary switch and a decelerator to which motive power of the motor is supplied;

a brush stick which is connected to a revolving axis of the decelerator; and a mascara brush installed at the end of the brush stick.

Here it is preferable that the mascara brush is formed by piling disk-type comb tooth in serial with a space enough to form a trough, where mascara solution can be charged, and in zigzag so that eccentricity is generated; and an eyelash curling portion and a mascara solution applying portion with shorter length then the eyelash curling portion are formed at the mascara brush

ADVANTAGEOUS EFFECTS

As described above, the electric mascara according to the present invention is safe when makeup of eyelash because safeness is secured by installing a mascara brush, where disk-type comb tooth are formed in serial with a space enough to form trough, where mascara solution can be maintained, and disk-type comb tooth are formed to have eccentricity in one, two, or three directions from the center axis. The shape of the disk-type comb tooth is one of a circle-like, a triangle-like, a water drop, an ellipse-like, etc.

In addition, by the electric mascara according to the present invention, mascara solution can be pasted to eyelash sufficiently and evenly, thereby clear and sweet makeup of eyelash can be performed because disk-type comb tooth has a mascara solution applying portion to apply mascara solution to eyelash widely and an eyelash curling portion which digs among eyelash to curl eyelash and pates applied mascara solution to eyelash finely

BRIEF DESCRIPTION OF THE DRAWINGS

The above and other features and advantages of the present invention will become more apparent by describing in detail preferred embodiments thereof with reference to the attached drawings in which:

FIG. 1 is a perspective view illustrating an electric mascara according to the present invention;

FIG. 2 is a perspective view illustrating an exemplary mascara brush, which is installed to the electric mascara according to the present invention;

FIG. 3 is a plain view of the mascara brush shown in FIG. 2;

FIG. 4 is a sectional view of the mascara brush, shown in FIG. 3, along A-A' line;

FIG. 5 is a perspective view illustrating another exemplary mascara brush, which is installed to the electric mascara according to the present invention;

FIG. 6 is a plain view of the mascara brush shown in FIG. 2;

FIG. 7 is a sectional view of the mascara brush, shown in FIG. 3, along A-A' line;

FIG. 8 is a still another exemplary mascara brush, which is installed to the electric mascara according to the present invention;

FIG. 9 is a plain view of the mascara brush shown in FIG. 8;

FIG. 10 is a sectional view of the mascara brush, shown in FIG. 9, along A-A' line;

FIG. 11 is a still another exemplary mascara brush, which is installed to the electric mascara according to the present invention;

FIG. 12 is a still another exemplary mascara brush, which is installed to the electric mascara according to the present invention;

FIG. 13 is a view illustrating a rotary switch when the electric mascara according to the present invention is turned off;

FIG. 14 is a view illustrating a rotary switch when the mascara brush is revolved forwardly by rotating the rotating handle clockwise; and FIG. 15 is a view illustrating a rotary switch when the mascara brush is revolved reversely by rotating the rotating handle counterclockwise.

BRIEF DESCRIPTION OF NUMERALS IN DRAWINGS

10 . . . mascara container
20 . . . mascara cap
21*a*, 21*b*; pole earth piece
22*a*, 22*b*; moving hole
50 . . . rotary switch
51*a*, 51*b* . . . moving restraining hole
52 . . . battery +(plus) earth piece
53 . . . battery −(minus) earth piece
60 . . . rotating handle
62 . . . battery cap
70 . . . brush stick
71 . . . D-cutting hole
100 . . . mascara brush
101 . . . center axis
102 . . . disk-type comb tooth
03 . . . eyelash curling portion
104 . . . mascara applying portion
105 . . . inserting portion
106 . . . trough

BEST MODE FOR CARRYING OUT THE INVENTION

An electric mascara according to the present includes a cap including a rotary switch which is operated by a handle, a motor which is operated according to the ON/OFF operation of the rotary switch and a decelerator to which motive power of the motor is supplied;

a brush stick which is connected to a revolving axis of the decelerator; and a mascara brush installed at the end of the brush stick.

Here it is preferable that the mascara brush is formed by piling disk-type comb tooth in serial with a space enough to form a trough, where mascara solution can be charged, and in zigzag so that eccentricity is generated; and an eyelash curling portion and a mascara solution applying portion with shorter length then the eyelash curling portion are formed at the mascara brush.

Mode for the Invention

Reference will now be made in detail to the embodiments of the present invention, examples of which are illustrated in the accompanying drawings, wherein like reference numerals refer to the like elements throughout. The embodiments are described below to explain the present invention by referring to the figures. For the sake of clearness and concision, technology related to the present invention that is not novel and is well known in the art to which present invention pertains will not be described herein.

As shown in FIGS. 1 through 15, an electric mascara according to the present invention comprises of a mascara container 10, where mascara solution is contained, and a mascara brush 100, which charges the mascara solution contained in the mascara container 10 and pastes charged mascara solution to eyelash. The mascara brush 100 is installed to a brush stick 70, which is provided at a cap 20.

A blade 11, which is provided at the opening portion of the mascara container 10, allows that mascara solution of appropriate amount is remained at the mascara brush 100.

A motor 1 and a decelerator 2 is provided in the cap 20. A rotary switch 50 including a battery 3, which drives the motor 1, is provided at the upper portion of the motor 1.

The revolving force of the motor 1 is decelerated by the decelerator 2 up to maintain the revolving speed at 25-30 rpm so that the mascara brush 100 can be revolved at an appropriate speed to makeup eyelash.

The brush stick 70 is connected to the shaft 2*a* of the decelerator 2, which decelerates the revolving speed of the motor 1, in the manner of D-cutting and the mascara brush 100 is installed at the brush stick 70.

The mascara brush 100 is constructed by piling disk-type comb tooth 102 in series so that a trough 106 to charge mascara solution therein is formed. The disk-type comb tooth 102 is formed to have eccentricity from the center axis 101.

There are various types of disk-type comb tooth 102, which is formed to have eccentricity from the center axis 101; one is formed to have eccentricity in both directions by piling disk-type comb tooth 102 in zigzag; another one is formed to have eccentricity in one direction by piling disk-type comb tooth 102 in the form of an arc; and still another one is formed to have eccentricity in three directions in zigzag while crossing each other.

The disk-type comb tooth 102 having eccentricity is divided into two portion; one is a eyelash curling portion 103, which is longer from the center axis 101, and the other is a mascara applying portion 104 which is shorter from the center axis 101.

The shape of the disk-type comb tooth 102 is various. The shape of the disk-type comb tooth 102 can be a circle-like, a triangle-like, an ellipse-like, a water-drop, etc. It must be noticed that the shape of the disk-type comb tooth 102 can be more various and thus it should not limited to the aforementioned ones.

The mascara brush 10 is made by silicon rubber. The operation and revolving direction of the mascara brush 100 are selected by a rotary switch 50, which supplies a power of a battery 3 to the motor 1 selectively.

The motor 1 and the decelerator 2 are installed in the cap 20. After installing the motor 1 and the decelerator 2, the rotary switch 50 is installed above the motor 1.

The rotary switch 50 is installed when moving restriction protrusion 51*a* and 51*b* are located at the center of moving hole 22*a* and 22*b*, which are formed at the upper circumstance of the cap 20. After that, a rotating handle 60 is installed above the cap 20 in the manner of under-cut.

After the rotating handle 60 is installed, a battery 3 is inserted into a battery settling hole 54 of the rotary switch 50.

The +(plus) pole and −(minus) pole of the battery 3 are connected to a battery + pole piece 53 and a batter −pole piece 52, respectively.

When the battery 3 is installed in the rotary switch, the rotating handle 60 is covered by a battery cap 62.

When the installation of the cap 20 is finished by installing a motor 1, the decelerator 2 to decelerate the revolving speed of the motor, and the rotary switch 50 to supply the motor 1 with a power or the battery 3 selectively, a brush stick 70 with the mascara brush 100 is inserted into the rotating axis 2*a* of the decelerator 2.

The mascara brush 100 is assembled to a brush stick 70 by inserting an insertion portion 105, which is protruded from the body of the mascara brush 100, into an assembling hole, which is formed by a tip of the brush stick 70.

When inserting the brush stick 70 with the mascara brush 100, a D-cutting hole 71, which is formed at the top of the brush stick 70, is inserted into the rotation axis 2*a* of the decelerator 2 while a upper portion of the brush stick 70 is directed toward the bottom of the cap 20.

When makeup of eyelash using the electric mascara, which is assembled as described above, mascara solution contained in the mascara container 10 is charged to the mascara brush 100 which is installed at the brush stick 70.

After mascara solution is charged to the mascara brush 100, the mascara brush 100 is pulled out from the mascara container 10.

After that, the mascara brush 100 starts to revolve by operating the rotating handle 60.

FIG. 13 shows the state that the power of the battery 3 is blocked when the rotating handle 60 is located at the neutral position.

None of the battery + connection piece 52 and the battery − connection piece 53 is connected to pole connection piece 21*a* and 21*b*.

When makeup of eyelash, the mascara brush 100 can be revolved in one direction by operating the rotating handle 60.

When the rotating handle 60 is rotated clockwise as shown in FIG. 14, the battery+connection piece 52, which is connected to the +pole of the battery 3, is connected to the pole connection piece, which is connected to the pole connection piece 21*a* and otherwise the battery-connection piece 53, which is connected to the +pole of the battery 3, is connected to the pole connection piece, which is connected to the pole connection piece 21*b* of the motor 1. As the power of the battery 3 is supplied to the motor 1, as shown in FIG. 14, the mascara brush 100 installed at the brush stick 70 is revolved clockwise.

When the rotating handle 60 is revolved counterclockwise as shown in FIG. 15, the battery+connection piece 52, which is connected to the +pole of the battery 3, is connected to the pole connection piece, which is connected to the pole connection piece 21*b* and otherwise the battery-connection piece 53, which is connected to the +pole of the battery 3, is connected to the pole connection piece, which is connected to the pole connection piece 21*a*. As the power of the battery 3 is supplied to the motor 1, as shown in FIG. 15, the mascara brush 100 installed at the brush stick 70 is revolved counterclockwise.

User can makeup eyelash by the mascara brush 100 whose revolving direction is selected by the control of the rotating handle 50.

If the mascara brush 100, whose revolving direction is selected as described above is touched to eyelash, mascara solution which is charged at the trough, which is formed between disk-type disk tooth 102, is applied to eyelash roughly by the mascara applying portion 104 whose length from the center axis 101 is shorter.

In addition, the eyelash curling portion 103, whose length from the center axis 101, combs eyelash while it digs into eyelash deeply, so that mascara solution, which is applied to eyelash by the mascara applying portion 104 widely, can be pasted to eyelash evenly.

The reason why mascara solution can be applied to eyelash widely is that the mascara applying portion 104, whose length from the center axis 101 is shorter, cannot dig into eyelash deeply. Further, mascara solution at the trough 106, which is formed at the side of the mascara applying portion 104, is charged to cover the mascara applying portion 104.

Further, curling of eyelash can be performed effectively, because the eyelash curling portion 103 combs eyelash up while it digs into eyelash deeply.

INDUSTRIAL APPLICABILITY

The present invention relates to an electric mascara for makeup of eyelash.

The electric mascara according to the present invention is safe when makeup of eyelash because safeness is secured by installing a mascara brush, where disk-type comb tooth are formed in serial with a space enough to form trough, where mascara solution can be maintained, and disk-type comb tooth are formed to have eccentricity in one, two, or three directions from the center axis.

The invention claimed is:

1. An electric mascara comprising;

a cap including restriction protrusion located at the center of moving hole formed at the upper circumstance of the cap;

a rotary switch which is operated by a handle, a motor which is operated according to the ON/OFF operation of the rotary switch, and a decelerator to which a motive power of the motor is supplied;

a brush stick which is connected to a rotating axis of the decelerator; and a mascara brush installed at an end of the brush stick, wherein, the mascara brush is formed by piling disk-type comb teeth in serial with a space enough to form a trough, where mascara solution can be charged, and in zigzag so that eccentricity is generated; and an eyelash curling portion and a mascara solution applying portion with shorter length than the eyelash curling portion are formed at the mascara brush, wherein the disk-type comb teeth are parallel to each other, wherein the disk-type teeth are tapered toward outer perimeter thereof, and wherein adjacent disk-type comb teeth are close enough so that much mascara solution can be applied to the trough.

2. The electric mascara in claim 1, wherein the disk-type comb tooth is formed to have eccentricity from the center axis of the mascara brush in a direction, in two direction, or in three direction.

3. The electric mascara in claim 1, wherein shape of the disk-type comb tooth is one of a circle-like, a triangle-like, a water drop, and an ellipse-like.

4. The electric mascara in claim 1, wherein the mascara brush is made of rubber.

5. The electric mascara in claim 1 further comprising:

a blade which is provided at the opening portion of a mascara container containing mascara solution and allows that mascara solution of appropriate amount is remained at the mascara brush.

* * * * *